US011415317B2

(12) United States Patent
Pancolini

(10) Patent No.: US 11,415,317 B2
(45) Date of Patent: Aug. 16, 2022

(54) COMBUSTION HEAD WITH LOW EMISSION OF NOX FOR BURNERS AND BURNER COMPRISING SUCH A HEAD

(71) Applicant: C.I.B. UNIGAS S.P.A., Campodarsego (IT)

(72) Inventor: Riccardo Pancolini, Campodarsego (IT)

(73) Assignee: C.I.B. UNIGAS S.P.A., Campodarsego (IT)

( * ) Notice: Subject to any disclaimer, the term of this patent is extended or adjusted under 35 U.S.C. 154(b) by 188 days.

(21) Appl. No.: 16/626,146

(22) PCT Filed: Jun. 26, 2017

(86) PCT No.: PCT/IB2017/053797
§ 371 (c)(1),
(2) Date: Dec. 23, 2019

(87) PCT Pub. No.: WO2019/002908
PCT Pub. Date: Jan. 3, 2019

(65) Prior Publication Data
US 2020/0224871 A1 Jul. 16, 2020

(51) Int. Cl.
*F23D 14/22* (2006.01)
*F23D 14/26* (2006.01)
*F23D 14/70* (2006.01)

(52) U.S. Cl.
CPC ..... *F23D 14/22* (2013.01); *F23D 14/26* (2013.01); *F23D 14/70* (2013.01); *F23D 2900/14004* (2013.01)

(58) Field of Classification Search
CPC ..... F23D 14/22; F23D 14/24; F23D 14/26; F23D 14/64; F23D 14/70; F23D 2900/14004
See application file for complete search history.

(56) References Cited

U.S. PATENT DOCUMENTS 5,494,437 A * 2/1996 Kubota ..... F23C 9/006 431/181
5,863,192 A * 1/1999 Motegi ..... F23D 14/22 431/8

(Continued)

FOREIGN PATENT DOCUMENTS

DE 3738141 A1 * 5/1989 ..... F23C 5/06
DE 3738141 A1 5/1989

(Continued)

OTHER PUBLICATIONS

Machine Translation of Hermann (Year: 1989).*

(Continued)

*Primary Examiner* — Jason Lau
(74) *Attorney, Agent, or Firm* — Seyfarth Shaw LLP

(57) ABSTRACT

A combustion head for burners, comprising an outer tubular body for channeling combustion air, an inner tubular body for channeling a fuel and a diffuser extending between the inner tubular body and the outer tubular body, said diffuser being disc-shaped and defining a slot for passage of the air between said diffuser and the outer tubular body. The outer tubular body has a lip 15 converging towards the main axis at the emission portion so as to define a narrowing of said slot for passage of the combustion air, so that for predefined flow rates of fuel and combustion air, the ratio of the velocity of the exiting fuel to the velocity of the combustion air exiting from the passage slot ranges between 1.8 and 3.

16 Claims, 9 Drawing Sheets

(56) References Cited

U.S. PATENT DOCUMENTS

| | | | | | |
|---|---|---|---|---|---|
| 5,944,503 | A * | 8/1999 | Van Eerden | ..... | F23D 23/00 431/9 |
| 6,857,868 | B1 * | 2/2005 | Li | ..... | F23D 14/36 431/187 |
| 2014/0199647 | A1 * | 7/2014 | Cadima | ..... | F23D 14/64 431/353 |
| 2016/0348904 | A1 * | 12/2016 | Gangoli | ..... | F23L 7/007 |

FOREIGN PATENT DOCUMENTS

| | | | | | |
|---|---|---|---|---|---|
| EP | 0738854 | A2 | 10/1996 | | |
| EP | 0884528 | A2 * | 12/1998 | ..... | F23D 14/22 |
| EP | 0884528 | A2 | 12/1998 | | |
| KR | 100784881 | B1 | 12/2007 | | |
| KR | 101697123 | B1 * | 1/2017 | ..... | F23D 14/70 |
| KR | 101697123 | B1 | 1/2017 | | |

OTHER PUBLICATIONS

Machine Translation of Lee et al (Year: 2017).*
International Search Report for PCT/IB2017/053797 dated Feb. 28, 2019.

* cited by examiner

ANSYS
Total Temperature
Contour 5
[K]
3.000e+003
3.000e+003
3.000e+003

COMBUSTION HEAD WITH LOW EMISSION OF NOX FOR BURNERS AND BURNER COMPRISING SUCH A HEAD

TECHNICAL FIELD

The object of the present invention is a combustion head suitable for application in burners that shall be installed on a combustion chamber, particularly on boilers, furnaces, driers, etc. The burners can be fuelled by a combustible gas or a mixture of gases (gas and diesel fuel or gas and fuel oil or other gases and suchlike not expressly indicated here).

Preferably (but not exclusively), the present invention is applied to burners suitable for operating with a thermal load of up to 1.5 megawatts/cubic metre under appropriate installation conditions. However, the present invention could also be applied to burners suitable for operating with a thermal load higher than 1.5 megawatts/cubic meter.

In further detail, the object of the present invention is the front part of the burner that is called the "head" and which, in use, is introduced inside the combustion chamber, the functions of which are those of optimizing the process of mixing the fuel and the combustion agent for the purpose of achieving optimal flame development with reference to the power burned (kW) and to the minimum excess air level needed to ensure efficient combustion, avoiding the production of CO.

STATE OF THE ART

Various combustion head shapes are currently known and they share the presence of an outer tubular body and an inner tubular body for supplying the gas, fixed at the rear to the burner body and terminating in the front with a gas distributor. In other words, the two tubular bodies are coaxial and the combustion air is supplied between them.

As conceived in the prior art, the head terminates with a diffuser that is usually disc-shaped (herein below also called a disc).

Moreover, fuel distribution conduits branch off from the inner tubular body and bring the gas towards a peripheral area of the head.

In some cases, these conduits may be slightly forwardly inclined with reference to the direction of emission of the combustion air. At a part of the nose arranged beyond the disc, the inner tubular body may preferably have holes of small dimensions for the emission of the so-called root gas, which prevents detachment of the flame from the combustion head 1 and ensures flame stability, facilitating ignition of the burner.

The diffuser is normally provided with passage holes or openings uniformly distributed on its annular flat bottom that is fixed to the collar of the inner tubular body, the collar also being perforated. These apertures make it possible for the combustion air to pass into the area for mixing it with the fuel and for igniting the flame.

The outer tubular casing, with its cylindrical body, conveys the combustion air blown by the fan of the burner.

However, the technical solutions described above, when applied to currently known combustion heads, do not make it possible to remain below the further limits regarding $NO_x$ emission (Nitrogen oxides and mixtures thereof) established by recent regulations soon to be in force and that set ever-decreasing limits (mg/kWh) for burners for civil and industrial use.

AIM OF THE INVENTION

In this context, the aim of the present invention is to realize a combustion head 1 that can overcome the cited drawbacks.

A particular aim of the present invention is to realize a combustion head that makes it possible to reduce NOx emission levels with the power produced remaining equal.

A further aim of the present invention is to realize a combustion head that makes it possible to reduce NOx emission levels, however, without increasing the values of other polluting substances (such as carbon monoxide for example).

The aims indicated above are substantially achieved by a combustion head for burners and by a burner 100 comprising said head 1 according to that which is set forth in the appended claims.

BRIEF DESCRIPTION OF THE DRAWINGS

Further characteristics and advantages of the present invention will become more apparent from the detailed description of several preferred, but not exclusive, embodiments, which are illustrated in the attached drawings, of which.

DETAILED DESCRIPTION OF PREFERRED EMBODIMENTS OF THE INVENTION

Figure 1:
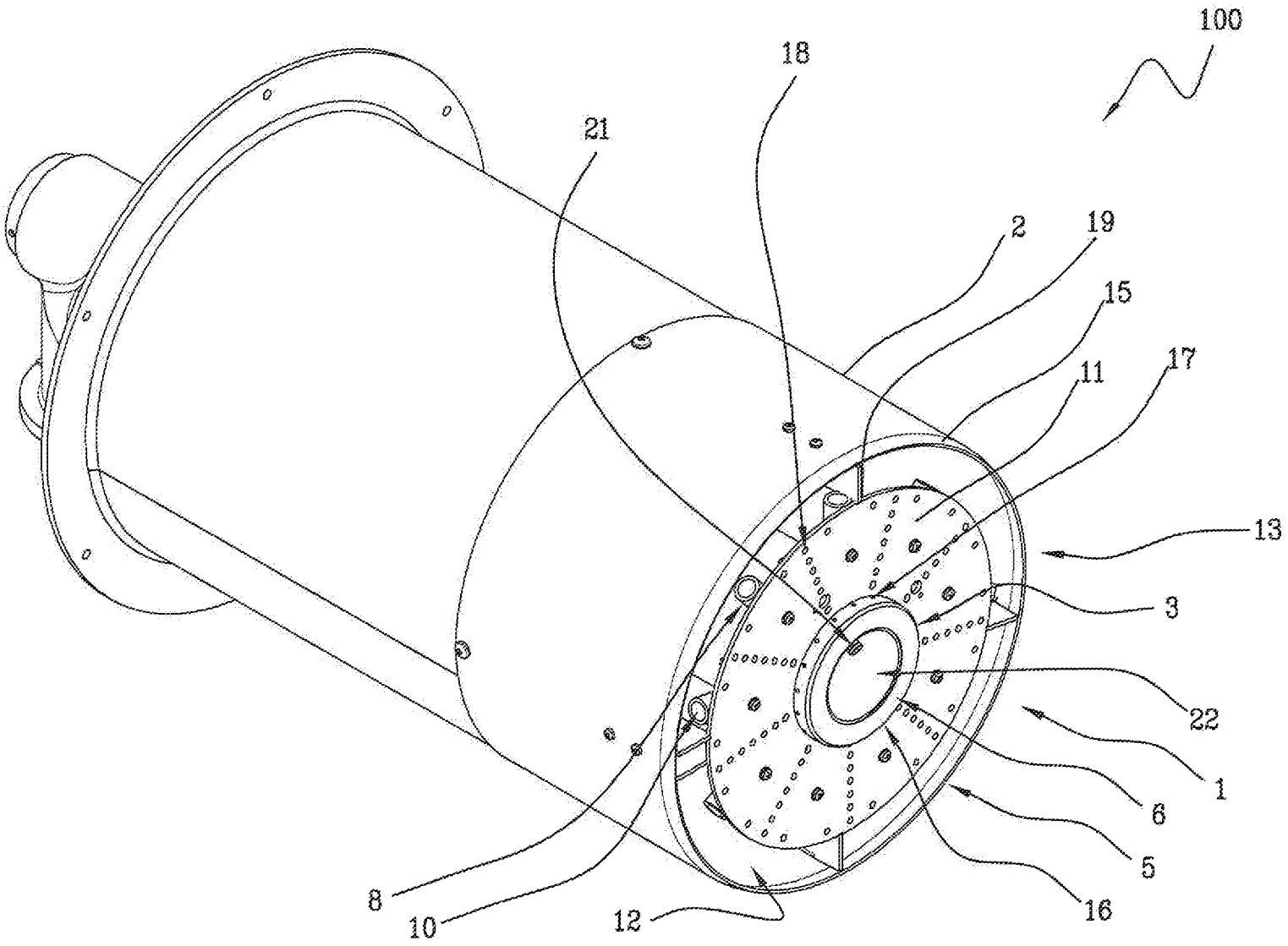
FIG. 1 is an axonometric view of a burner comprising the combustion head according to the present invention.
Figure 2:
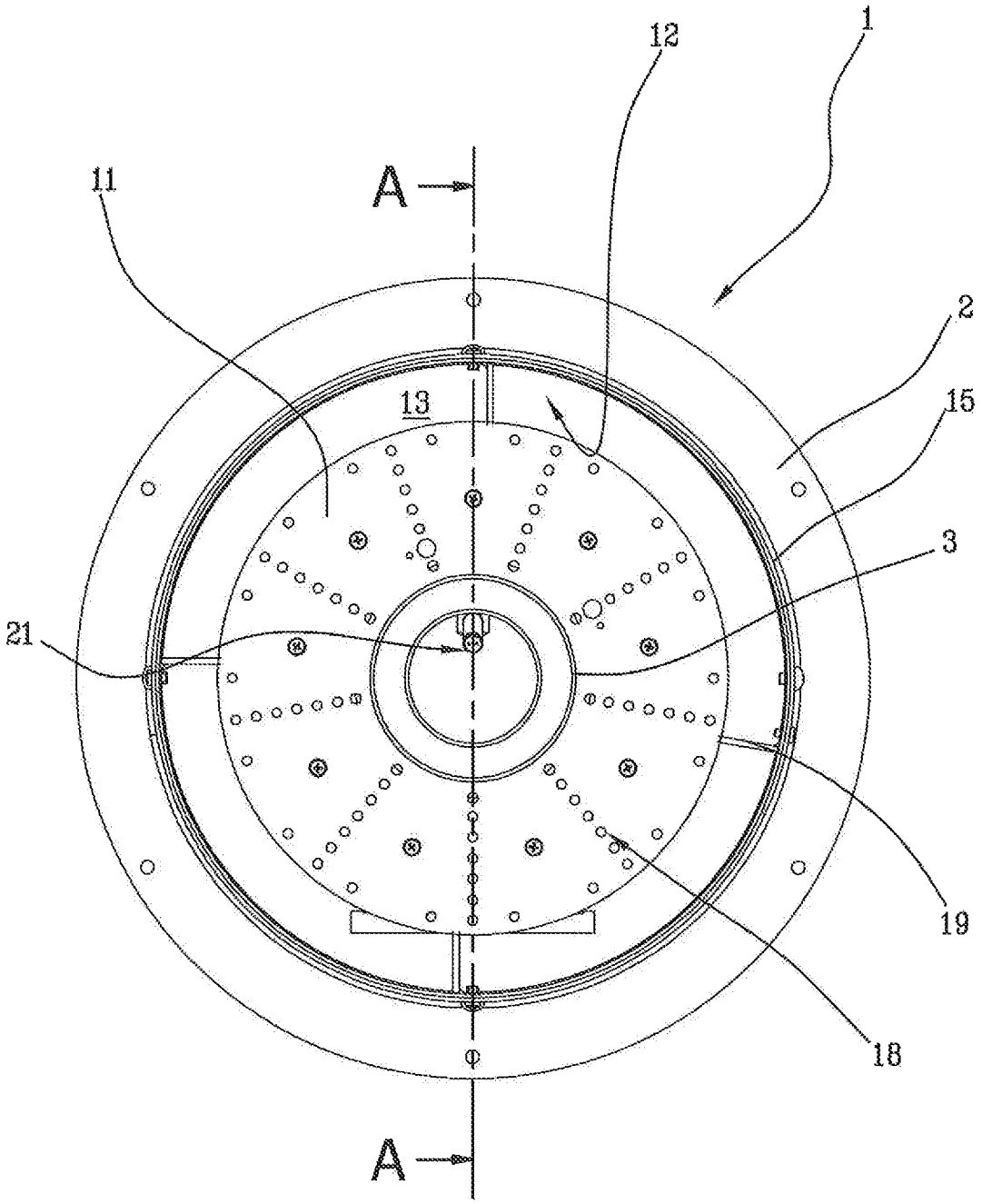
FIG. 2 is a front view of the burner appearing in FIG. 1 from the front side.
Figure 3:
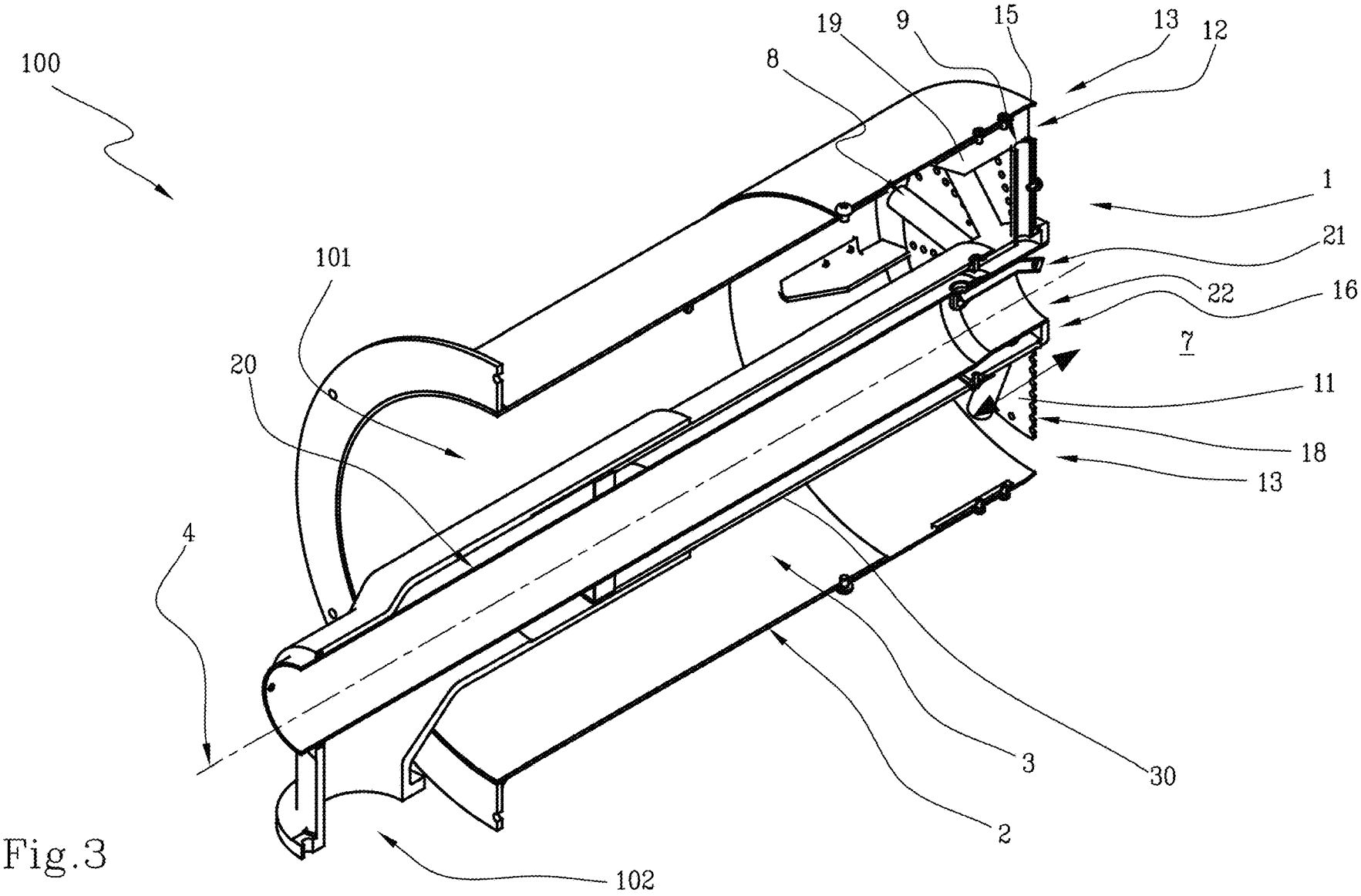
FIG. 3 is a side axonometric view of a section of the burner of FIG. 2 along the section line A-A.
Figure 4:
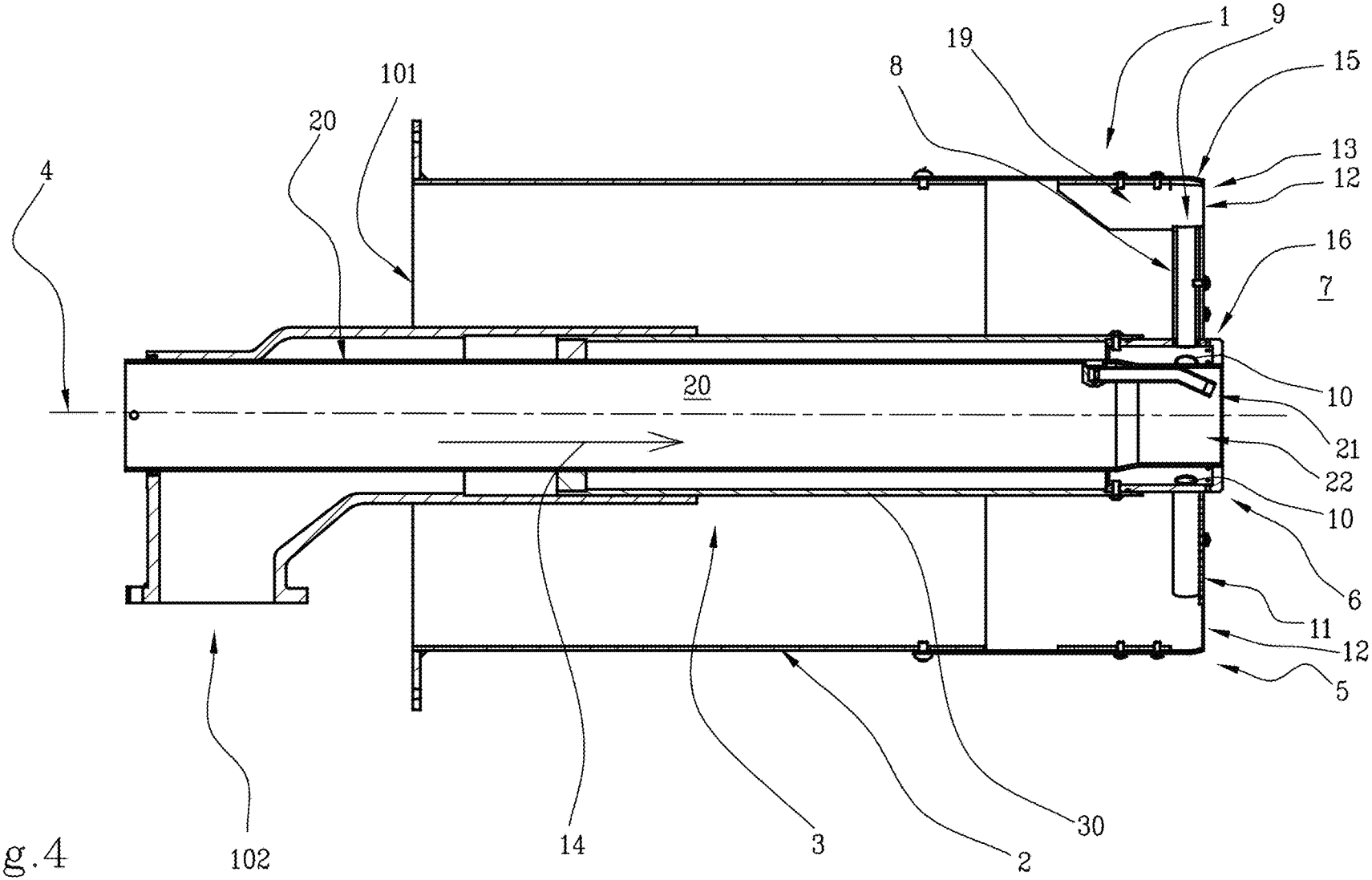
FIG. 4 is a side view of the section of FIG. 3.
Figure 5:
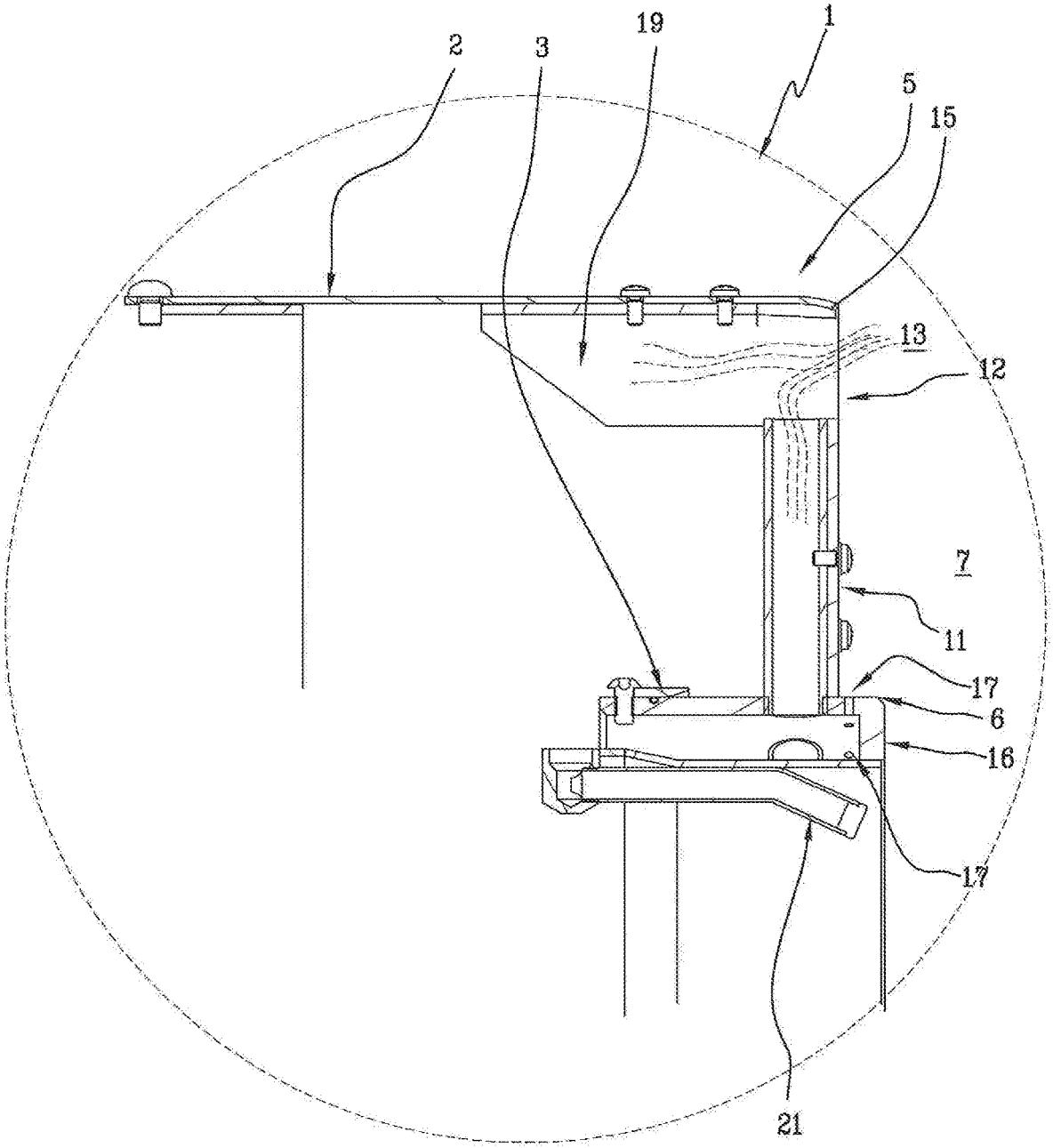
FIG. 5 is a side view of an enlargement of the air and fuel mixing part of the section of FIG. 4.

With reference to the figures cited, a burner comprising a combustion head 1 according to the present invention is indicated in its entirety by reference number 100.

As partly described above, the combustion head 1 comprises an outer tubular body 2 for channelling combustion air and an inner tubular body 3 for channelling a fuel. In particular, the combustion air is supplied between the inner tubular body 3 and the outer tubular body 2, whereas the fuel is supplied in the inner tubular body 3.

Both tubular bodies 2, 3 extend along a main axis 4 of the head 1 to a respective emission portion 5, 6 arranged in proximity to a mixing area 7, where, when in use, the flame is generated.

In other words, the two tubular bodies are coaxial with respect to each other and terminate at the mixing area 7.

As shall be explained in further detail below, the inner tubular body 3 preferably protrudes to a greater degree towards the mixing area 7 with a "nose-like" protrusion.

The inner tubular body 3 has a plurality of fuel emission conduits 8 (also called "nozzles") radially extending from the inner tubular body 3 towards the outer tubular body 2. These conduits are connected to respective holes 9 afforded around the inner tubular body 3 so as to distribute the fuel radially. In further detail, each emission conduit 8 terminates with a fuel outlet aperture 10 that faces a peripheral area of the head 1 (along a radial direction with reference to the main axis 4).

Preferably, the fuel emission conduits 8 are rectilinear in extension and even more preferably, perpendicular with respect to the inner tubular body 3.

The number of these emission conduits 8 may vary as a function of the structural design needs as shall be explained in further detail below.

Moreover, the head 1 comprises a diffuser 11 that extends radially between the inner tubular body 3 and the outer tubular body 2. This diffuser is fastened to the inner tubular body 3 preferably by means of threaded connections realized on each emission conduit 8.

Moreover, the diffuser 11 is preferably disc-shaped (herein below it is also simply defined by the term "disc") and it has a diameter smaller than the diameter of the outer tubular body 2 so that it can also fit inside the latter.

In particular, there is a (circumferential) slot 12 between said diffuser 11 and the outer tubular body 2 for passage of the combustion air at said peripheral area 13 of the head 1.

Figure 6:
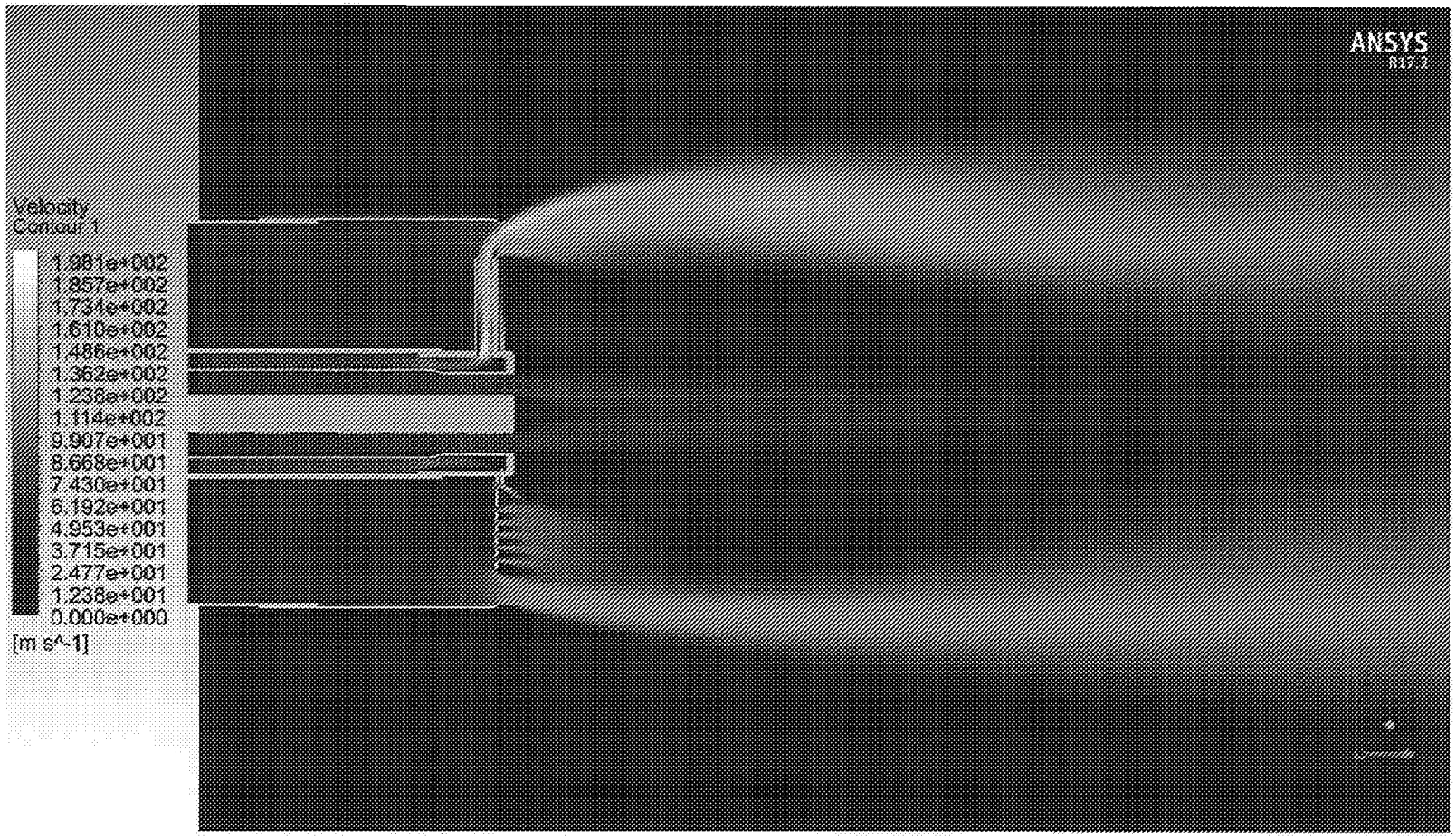
FIG. 6 shows the velocity field of the air and gas flows in the outlet area according to a side and sectional view along a longitudinal section plane that intersects the centreline of a radial gas emission conduit in the upper part thereof and the centreline in the space between two radial gas pipes in the lower part thereof.

The fuel emission conduits 8 have respective fuel outlet apertures 9 arranged at the slot 12 for passage of the combustion air so as to realize a mixture of the fuel and the combustion air. The velocity of the air flows in the outlet areas (lighter shades=higher velocity) can be observed in FIG. 6.

The diffuser disc 11 is preferably arranged in a position that is substantially aligned with the slot 12 along an imaginary plane arranged as resting on the outlet section of the outer tubular body 2 and with respect to a combustion agent and fuel supply direction 14.

According to the embodiment illustrated in the appended figures, the fuel emission conduits 8 (nozzles) are arranged upstream of the diffuser 11 with respect to a combustion air supply direction 14. More precisely, the fuel emission conduits 8 are arranged in back of the air diffuser disc 11. In further detail, these emission conduits 8 are connected to the disc (for example by means of screws). Therefore, the disc is aligned with the outlet slot 12 of the outer tubular body 2 and the fuel emission conduits 8 are found in an internal position with respect to the outer tubular body 2.

In an alternative embodiment, which is not illustrated in the appended figures, the fuel emission conduits 8 are found in front of the disc with respect to the combustion agent and fuel supply direction 14.

In this case, the disc is aligned with the slot 12 and the conduits are found in a slightly more external position with respect to the outer tubular body 2.

In both cases, the emission conduits 8 preferably have respective outlet apertures 9 that are leveled with respect to the edge of the disc-shaped diffuser 11. In other words, the outer diameter of the disc defines the terminal section of said emission conduits 8.

In accordance with the present invention, the outer tubular body 2 has a lip 15 converging towards the main axis 4 at the emission portion 5, 6 so as to define a narrowing of said slot 12 for passage of the combustion air. In other words, the convergent lip 15 defines a sort of bevelled edge that narrows the outlet section of the outer tubular body 2.

Preferably, said convergent lip 15 is shaped in a curved fashion and not as an oblique section.

Figure 7:
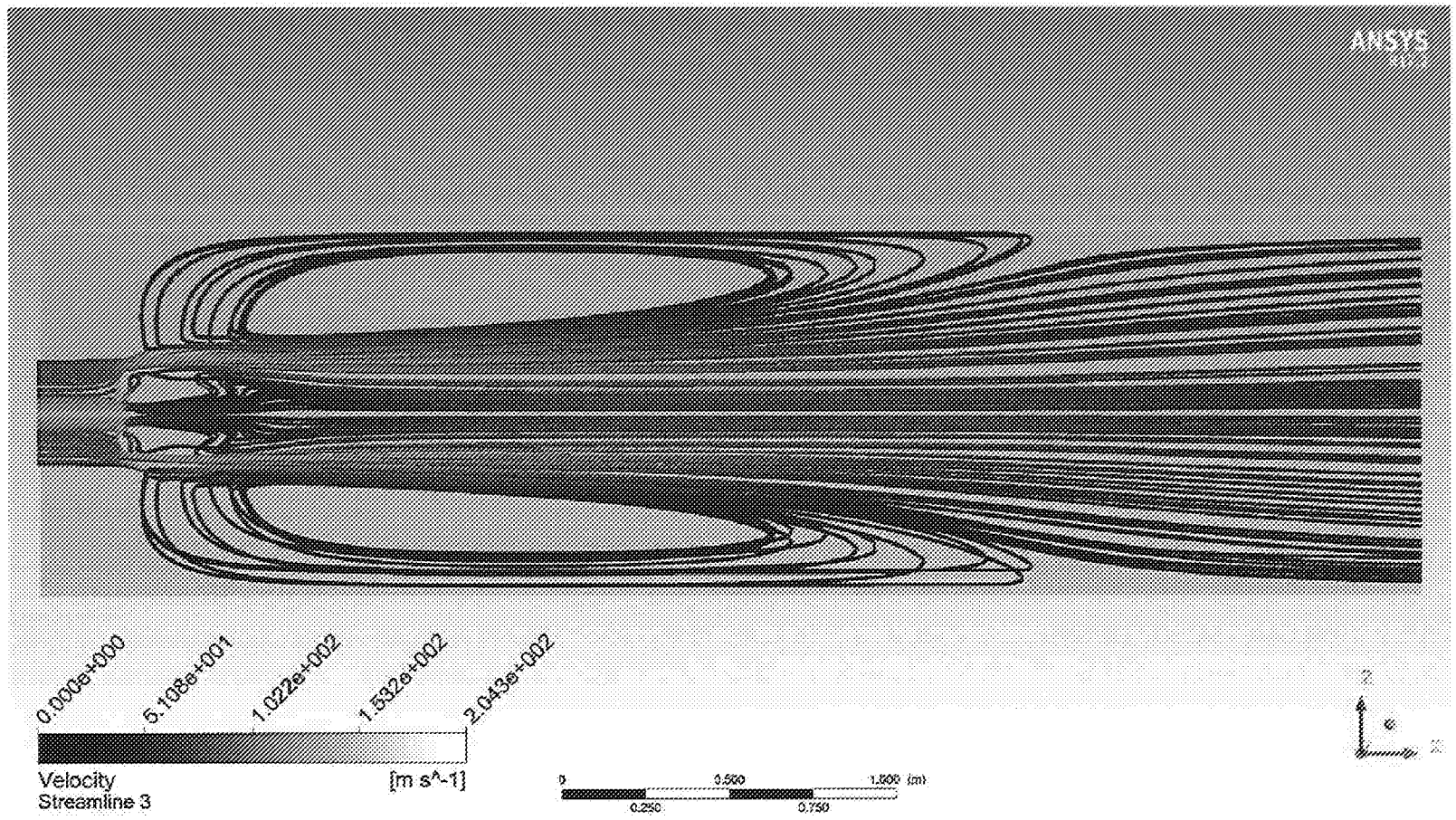
FIG. 7 shows the streamlines shaded according to the absolute velocity in the same view as in FIG. 6.
Figure 8:
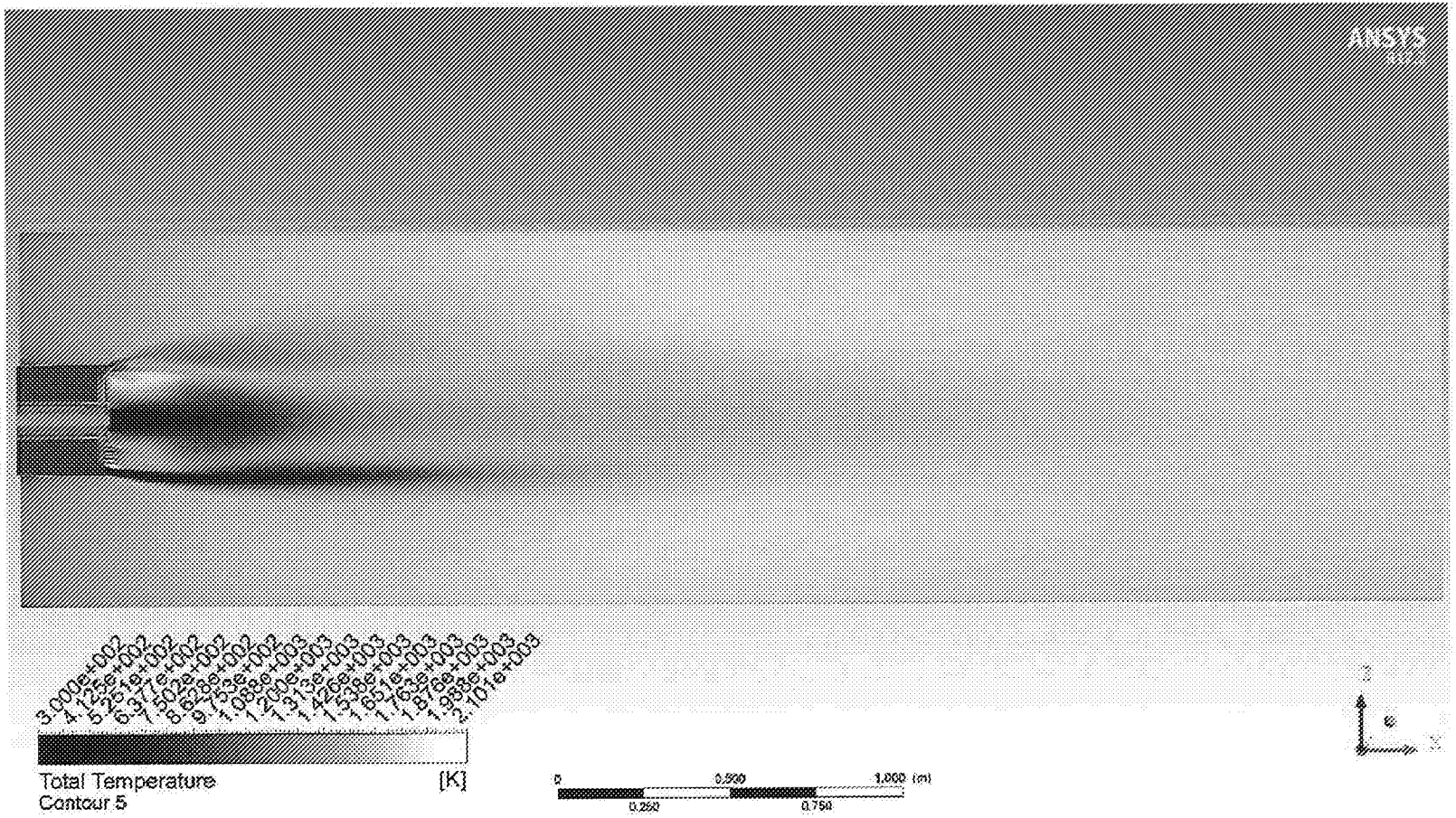
FIG. 8 shows the flame temperature in a side view according to a section of the same type indicated in FIG. 6.

Advantageously, this convergent lip 15 makes it possible to increase the outlet velocity of the air towards the mixing area 7 and to create a turbulent vortex exiting from the outer tubular body 2. In FIG. 7, it can be seen that in the upper part and in the lower part of the image, the streamlines close and turn back.

In further detail, the dimensional ratio of the diameter of the diffuser 11 to the diameter of the outer tubular body 2 at the convergent lip 15 ranges between 0.78 and 0.9, so that for predefined flow rates of fuel and combustion air, the ratio of the velocity of the fuel exiting from the outlet aperture 10 to the velocity of the combustion air exiting from the passage slot 12 ranges between 1.8 and 3.

Figure 9:
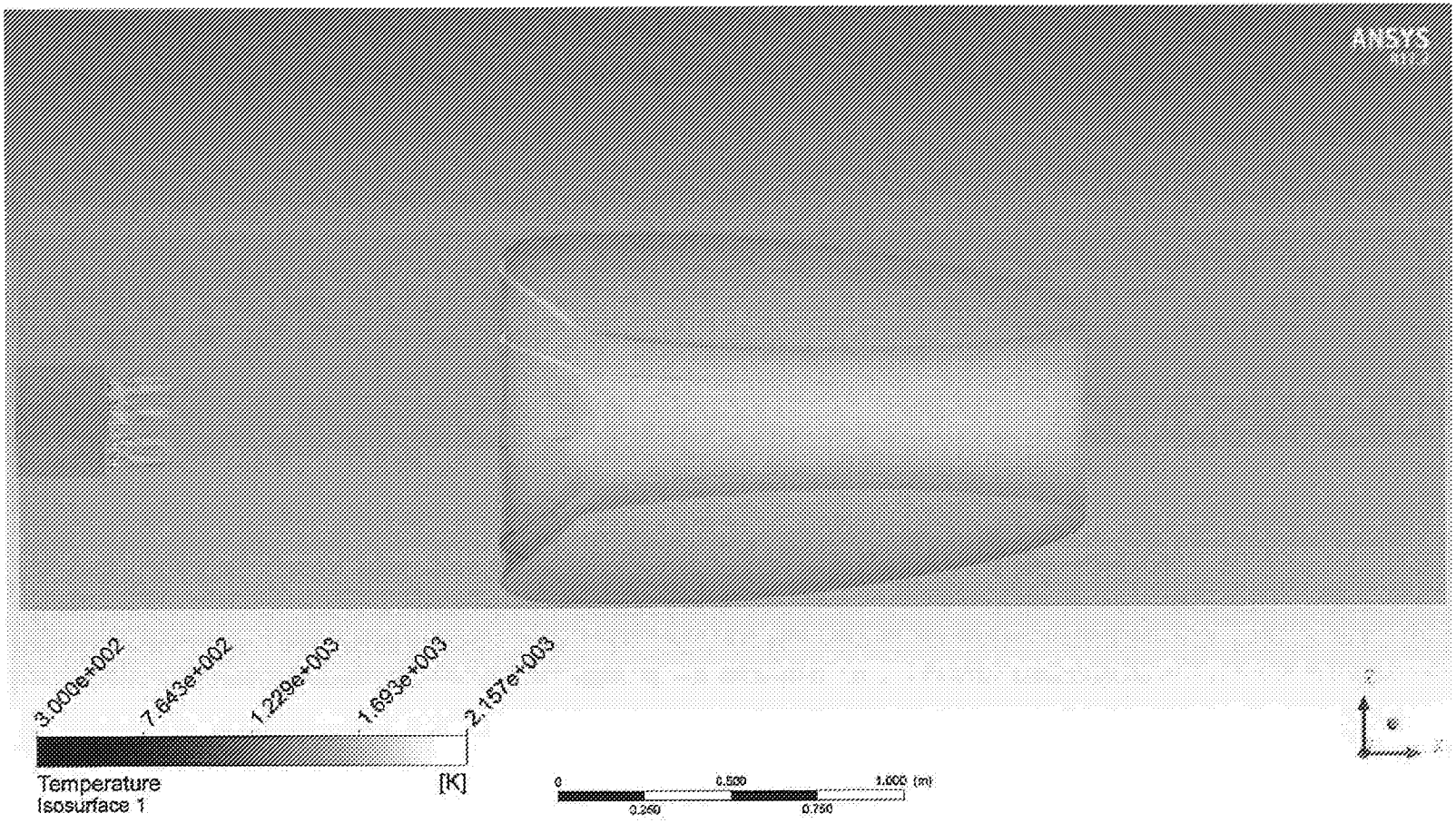
FIG. 9 shows the hotter zones of the flame temperature in the same view as in FIG. 6.

Advantageously, this shape of the head 1 makes it possible to create a slight detachment of the flame with respect to the disc so as to reduce the generation of NOx. In other words, this ratio of the gas velocity to the air velocity, and the direction of the flows as determined by the particular geometry of the head 1, makes it possible to lower the flame temperature at the disc so as to obtain lower NOx levels. This situation is observable in FIG. 9, in which an isosurface of constant temperature is represented. In particular, it can be seen that the hotter part of the retainer flame develops in proximity to the diffuser disc, whereas the hotter part of the main flame is detached from the head.

Preferably, the ratio of the diameter of the diffuser 11 to the diameter of the outer tubular body 2 at the convergent lip 15 is approximately equal to 0.8.

Preferably, said ratio of the velocity of the fuel exiting from the outlet aperture 10 to the velocity of the combustion air exiting from the passage slot 12 is approximately equal to 2.8.

It should be noted that the mean velocity of the flow of air at the peripheral area 13 is in the range of 40 to 50 meters per second. The mean velocity of the flow of fuel at the peripheral area 13 is in the range of 130 to 140 meters per second.

In other words, the fuel exits from the emission conduits 8 at a higher velocity (more than double) than the velocity of the air.

In one exemplary embodiment, the diameter of the outer tubular body 2 at the convergent lip 15 is equal to about 320 mm, whereas the diameter of the disc is equal to 260 mm.

The ratio of the thickness of the passage slot 12 at the convergent lip 15 (measured as the distance between the disc and the outer edge of the convergent lip 15 along a direction perpendicular to the main axis 4), to the diameter of the aperture of each emission conduit 8, is a function of the number of emission conduits 8 that are utilized.

The thickness of the passage slot 12 at the convergent lip 15 is preferably greater than the diameter of the aperture of each emission conduit 8.

In the preferred case represented in the figures, the diameter of the aperture of each emission conduit 8 is equal to about 13 mm.

In this case, there are nine emission conduits 8. However, in other embodiments, the number of emission conduits 8 may be greater than nine or less than nine. In the case in which the number of conduits is greater than a given pre-established number (e.g. nine), the diameter of the aperture of each emission conduit 8 decreases (e.g. to less than 13 mm) or if the number of conduits is less than a given pre-established number (e.g. nine), the diameter of the aperture of each emission conduit 8 increases (e.g. to less than 13 mm). In other words, the inner diameter of the aperture of each emission conduit 8 is a function of the number of emission conduits 8 applied to ensure a combustion agent velocity value in keeping with the design data.

Moreover, it should be noted that the diffuser 11 is preferably connected to the inner tubular body 3 and together with the latter, it defines a single structure that is movable axially with respect to the outer tubular body 2. Advantageously, the operator can move this structure from the outside so as to adjust the flame.

It should be noted that this single structure is movable from a position in which the disc is substantially aligned with the slot 12 to a position further upstream with respect to the slot 12 along a combustion air supply direction 14. In other words, the disc is not movable towards a more external position 12 with respect to the slot 12.

Moreover, the inner tubular body 3 extends beyond the diffuser 11, with respect to a combustion air supply direction, thereby defining a nose-like protrusion 16. Said nose-like protrusion 16 has fuel outlet holes 17 to define a flame retainer. The outlet holes 17 are arranged radially with respect to the main axis 4.

Preferably, the dimensions of the gas outlet holes 17 are adjustable from the outside to vary the outflow of the same fuel. In particular, such adjustment can take place by means of an additional tubular body 30 that is slidable with respect to the inner tubular body 3 so as to partially or totally overlap the holes 17 to adjust the diameter thereof. The sliding movement of the additional tubular body 30 can be carried out manually from the outside or by means of automated adjustment means.

Preferably, the nose-like protrusion 16 protrudes axially with respect to the disc by about 15 mm.

Moreover, the diffuser 11 has through holes 18 for the air to outflow towards the combustion area, in which said through holes 18 extend in the same direction as the combustion air supply direction 14.

For example, it can be seen in FIG. 1 that the holes 18 are distributed on the disc and preferably aligned along respective radial directions.

Between the disc and the outer tubular body 2, there are spacer tabs 19 preferably fixed to the inner surface of the outer tubular body 2. The disc rests internally against said tabs 19 so that the tabs define a sort of centring. Each tab 19 extends from the convergent lip 15 towards the inside of the outer tubular body 2 for a predefined length so as to support the disc in the course of the forward and backward movement. In other words, the tabs 19 are arranged "edgewise" with respect to the outer tubular body 2.

In addition to that which has been described above, the head 1 can comprise an additional conduit 20 for the combustion air, arranged inside the inner tubular body 3 (coaxial with it) and having an outlet section 22 arranged beyond the dispenser 11, with respect to a combustion air supply direction 14.

In other words, air is introduced inside the additional conduit 20, while outside of this conduit, but inside the inner tubular body 3 the fuel (gas) is supplied.

Moreover, in the appended figures, it is possible to observe a throat 21 for generation of the pilot ignition flame, which is not described here in further detail as it is known in the prior art.

At said throat 21, there are preferably one or more flame ignition electrodes of a known type, which are not shown in the appended figures. Furthermore, in the proximity of the disc, a flame detector is also preferably present. This flame detector is also of a known type and it is not shown in the appended figures.

An object of the present invention is constituted by a burner 100 comprising the combustion head 1 described hereinabove and means 101 for supplying the combustion air (preferably a fan) according to a predetermined flow rate.

Moreover, the burner 100 also comprises means 102 for supplying the fuel according to a predetermined flow rate.

It should be noted that the air supply means 101 is connected between the inner tubular body 3 and the outer tubular body 2 and the fuel supply means 102 is connected to the inner tubular body 3.

With reference to the simulations represented in FIGS. 6-9, a fully operational condition is shown with an air flow rate of 6790 $Sm^3/h$ and a fuel flow rate of 614 $Sm^3/h$, purely by way of example.

In particular, a combination of the following parameters makes it possible to lower the NOx levels produced by combustion even further:

- air flow rate brought about by the air supply means 101, and/or
- fuel flow rate brought about by the fuel supply means 102, and/or
- the shape of the convergent lip 15, and/or
- the dimensional ratio of the diameter of the diffuser 11 to the diameter of the outer tubular body 2 at the convergent lip 15 ranging between 0.78 and 0.9, and/or
- the ratio of the velocity of the fuel exiting from the outlet aperture 10 to the velocity of the combustion air exiting from the passage slot 12 being within the range of 1.8 to 3, and/or
- number and diameter of the fuel emission conduits 8, and/or
- position of the disc aligned with the slot 12, and/or
- adjustment of the aperture of the fuel outlet holes 17 at the nose-like protrusion 15.

As concerns the operation of the combustion head 1, it stems directly from that which is described hereinabove.

In particular, the air flows between the inner tubular body 3 and the outer tubular body 2 until it reaches the disc. The air exits from the disc holes towards the mixing area 7 and from the slot 12 that is found around the disc at the peripheral area 13.

The fuel is supplied inside the inner tubular body 3 and exits radially from the emission conduits 8 (nozzles) towards the slot 12 so that mixing is realized at the peripheral area 13.

At the same time, the gas also exits from the outlet holes 17 so as to define the so-called root gas.

In practice, in the peripheral and mixing area 13, the gas flows out from the emission conduits 8 and encounters the air exiting from the slot 12 so as to realize the mixing of the two. Owing to the particular geometry of the head 1 and to the ratio of the gas velocity with respect to the air velocity (about 2.8), there is a lowering of the flame temperature, as well as a detachment of the flame with respect to the disc—a phenomenon which makes it possible to reduce the generation of NOx.

It should be noted that the combustion head can be applied also as an addition to a waste gas recirculation system to obtain lower NOx values (approximately NOx<30 mg/m3 with 3.5% O2 in the waste gas and a thermal load of up to 1.5 MW/m3 or more). Therefore, the present invention does not exclude the application of the head in prior-art waste gas recirculation systems currently already being used to lower NOx levels.

The present invention achieves the set aims.

In particular, owing to the particular shape of the head 1, the present invention makes it possible to lower NOx emission for the reasons stated hereinabove.

It should also be noted that the present invention proves to be easily realized and that the cost for implementation of the invention is not very high.

The invention claimed is:

1. A combustion head for burners, comprising:

an outer tubular body for channeling combustion air, said body extending along a main axis of the head to an emission portion thereof arranged in proximity to a flame;

an inner tubular body for channeling a fuel, said body extending along said main axis of the head to an emission portion thereof arranged in proximity to the flame, said inner tubular body having a plurality of radially extending fuel emission conduits in the space surrounded by the outer tubular body;

a diffuser extending between the inner tubular body and the outer tubular body, said diffuser being disc-shaped and having an outer most circumferential edge having a constant diameter smaller than a diameter of the outer tubular body, there being defined a circumferential passage slot between said diffuser and the outer tubular body for passage of the combustion air at a peripheral area of the head, said fuel emission conduits having respective fuel outlet apertures arranged at the circumferential passage slot for passage of the combustion air so as to realize a mixture of the fuel and the combustion air; and characterized in that the outer tubular body has a lip converging towards the main axis at the emission portion so as to define a narrowing of the circumferential passage slot for passage of the combustion air; the dimensional ratio of the diameter of the diffuser to the diameter of the outer tubular body at the convergent lip ranging between 0.78 and 0.9, so that for predefined flow rates of fuel and combustion air, the ratio of the velocity of the fuel exiting from the outlet aperture to the velocity of the combustion air exiting from the circumferential passage slot ranges between 1.8 and 3.

2. The combustion head according to claim 1, characterized in that said ratio of the velocity of the fuel exiting from the outlet aperture to the velocity of the combustion air exiting from the circumferential passage slot is equal to 2.8.

3. The combustion head according to claim 1, characterized in that said convergent lip is shaped in a curved fashion.

4. The combustion head according to claim 1, characterized in that the ratio of the diameter of the diffuser to the diameter of the outer tubular body at the convergent lip is equal to 0.8.

5. The combustion head according to claim 1, characterized in that the thickness of the circumferential passage slot at the convergent lip is greater than the diameter of the aperture of each emission conduit.

6. The combustion head according to claim 1, characterized in that the diffuser is arranged in a position that is substantially aligned with the circumferential passage slot.

7. The combustion head according to claim 1, characterized in that the diffuser is connected to the inner tubular body and together they define a single structure that is movable axially with respect to the outer tubular body, said single structure being movable from a position that is substantially aligned with the circumferential passage slot to a position further upstream with respect to the circumferential passage slot along a combustion air supply direction.

8. The combustion head according to claim 1, characterized in that the fuel emission conduits are arranged upstream of the diffuser with respect to a combustion air supply direction.

9. The combustion head according to claim 1, characterized in that the fuel emission conduits are rectilinear in extension and perpendicular with respect to the inner tubular body.

10. The combustion head according to claim 1, characterized in that the emission conduits have respective outlet apertures that are levelled with respect to the outer most circumferential edge of the disc-shaped diffuser.

11. The combustion head according to claim 1, characterized in that said inner tubular body extends beyond the diffuser, with respect to a combustion air supply direction, thereby defining a nose-like protrusion.

12. The combustion head according to claim 11, characterized in that said nose-like protrusion has fuel outlet holes to define a flame retainer.

13. The combustion head according to claim 12, characterized in that the combustion head comprises adjustment means for adjusting said outlet holes, said means being configured to adjust the aperture of said outlet holes and being controllable manually or in an automated manner from the outside of the head.

14. The combustion head according to claim 1, characterized in that said diffuser has through holes for the outflow of air towards the flame, wherein said through holes extend in the same direction as the combustion air supply direction.

15. The combustion head according to claim 1, characterized in that it comprises an additional conduit for the combustion air, said conduit being arranged inside the inner tubular body and having an outlet section beyond the diffuser, with respect to a combustion air supply direction.

16. A burner comprising:

means for supplying the combustion air according to a predetermined flow rate; and means for supplying the fuel according to a predetermined flow rate;

characterized in that it comprises a combustion head according to claim 1, wherein the air supply means is connected between the inner tubular body and the outer tubular body and the fuel supply means is connected to the inner tubular body.

* * * * *